US006981846B2

(12) United States Patent
Liang

(10) Patent No.: US 6,981,846 B2
(45) Date of Patent: Jan. 3, 2006

(54) VORTEX COOLING OF TURBINE BLADES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 49 days.

(21) Appl. No.: 10/791,575

(22) Filed: Mar. 2, 2004

(65) Prior Publication Data

US 2005/0265837 A1 Dec. 1, 2005

Related U.S. Application Data

(60) Provisional application No. 60/454,120, filed on Mar. 12, 2003.

(51) Int. Cl.
*F01D 5/18* (2006.01)

(52) U.S. Cl. ..... 416/97 R

(58) Field of Classification Search ..... 416/97 R, 416/90 R; 415/115
See application file for complete search history.

(56) References Cited

U.S. PATENT DOCUMENTS 4,669,957 A * 6/1987 Phillips et al. ..... 416/97 R
2001/0016162 A1 * 8/2001 Lutum et al. ..... 416/97 R

* cited by examiner

*Primary Examiner*—Edward K. Look
*Assistant Examiner*—Richard A. Edgar
(74) *Attorney, Agent, or Firm*—Norman Friedland

(57) ABSTRACT

A near wall cooling technique for cooling the pressure and suction sides of a turbine airfoil that includes a matrix of cells oriented chord-wise and extending longitudinally having vortex chambers with vortex creating passages feeding coolant from interior of the blade to each of the cells, interconnecting passageways interconnecting each of the vortex chambers and discharge film cooling passageway discharging coolant adjacent the outer surface of the pressure and suction sides. The alternate passageways are staggered and each are tangentially oriented to introduce a swirling motion in the coolant as it enters each of the vortex chambers. The cells may be oriented to be in a staggered or in an in-line array and the number of cells, the number of vortex chambers and the dimension of the cells, vortex chambers and passageways are selected to match the heat load and the temperature requirements of the material of the blade. The direction of flow within each cell is selected by the designer. The aft portion may be internally cooled before discharging the coolant as a film upstream of the gage point to avoid aerodynamic losses associated with film mixing.

19 Claims, 3 Drawing Sheets

VORTEX COOLING OF TURBINE BLADES

This application claims benefit of a prior filed U.S. provisional application Ser. No. 60/454,120, filed on Mar. 12, 2003, entitled "NEAR WALL MULTI-VORTEX COOLING CONCEPT" by George Liang.

CROSS-REFERENCE TO RELATED APPLICATION

This patent application relates to U.S. pat. application Ser. No. 10/791,581 inasmuch as both inventions relate to cooled turbine blades and both inventions can be utilized together and is incorporated herein by reference.

TECHNICAL FIELD

This invention relates to air cooled turbines for gas turbine engines and particularly to cooling of the pressure and suction surfaces of the turbine blade with coolant air that has imparted thereto vortices.

BACKGROUND OF THE INVENTION

As is well known in the gas turbine engine technology, the efficiency of the engine is greatly enhanced by increasing the temperature of the turbine and/or reducing the amount of air that is required to maintain the turbine components within their tolerable limits. In other words, the material used for the turbine blades must be able to withstand the temperature and hostile environment that is seen in the turbine section. Engineers and scientist have been working for many years at improvements to provide materials capable of withstanding higher temperatures and to reduce the amount of coolant for achieving satisfactory cooling of the turbine components and particularly the turbine blade.

An example of cooled turbine blades is exemplified in U.S. Pat. No. 5,720,431 granted to Sellers, et al on Feb. 24, 1998 entitled COOLED BLADES FOR A GAS TURBINE ENGINE which teaches the use of feed chambers and feed channels where the feed channels extend from the root of the blade to the tip and include a discharge opening at the tip, the feed chamber connects to the source of coolant and through radial spaced impingement cooling holes replenishes the air in the feed channels. This teachings relate to the leading edge, trailing edge and the mid chord section. It is noted that this invention is principally concerned with the suction surface and the pressure surface in the mid chord section. This reference is incorporated herein by reference and should be referred to for a detailed description of air cooled turbine blades utilized in gas turbine engines.

U.S. Pat. No. 6,129,515 granted to Soechting, et al on Oct. 10, 2000 entitled TURBINE AIRFOIL SUCTION AIDED FILM COOLING MEANS is also included herein because not only does it describe cooled turbine blades, but it is particularly directed to teachings that is directed to means for slowing the velocity of the discharge air from the air film cooling holes so as to better disperse the air as it leaves the discharge ports and hence, tend to more effectively provide a film of cooling air adjacent to the outer surface at the pressure surface of the blade. It will be noted, for example, that the teaching includes step diffuser to attain a wider diffusion angle of the discharging film. This patent is also incorporated herein by reference.

U.S. Pat. No. 5,486,093 granted to Auxier et al on Jan. 23, 1996 entitled LEADING EDGE COOLING OF TURBINE AIRFOILS is included herein because it teaches the use of helix shaped cooing passages to enhance convective efficiency of the cooling air and to improve discharge of the film cooling air by orienting the discharge angle so that the discharging air is delivered more closely to the pressure and suction surfaces. The helix holes place the coolant closer to the outer surface of the blade to more effectively reduce the average conductive length of the passage so as to improve the convective efficiency. Also higher heat transfer coefficients are produced on the outer diameter of helix holes improving the capacity of the heat sink. This patent is likewise incorporated herein by reference.

As one skilled in this art will appreciate the heretofore design of cooled turbine blades typically utilize radial flow channels plus re-supply holes in conjunction with film discharge cooling holes as is exemplified in U.S. Pat. No. 5,720,431, supra. While this patent discloses a near wall cooling technique, this cooling construction approach has its downside because the hot gas temperature and pressure variation of the engine's working medium makes the control of the radial and chord-wise cooling flow difficult to achieve. A single pass radial channel flow as taught by the U.S. Pat. No. 5,720,431, supra, is not the ideal method of utilizing cooling air and as a consequence, this method results in a low convective cooling effectiveness.

The present invention obviates the problem noted in the above paragraph. The design philosophy of this invention as compared to the teachings noted above and the results obtained by the utilization of this invention as a cooling technique for turbine blades will enhance the cooling effectiveness and hence, will improve the efficiency of the engine. Essentially, this invention relates to cooling the surfaces of the pressure side and suction side of the airfoil and provides a matrix of square or rectangularly shaped cells (although other shapes could also be employed), each of which have discrete cooling passage(s) formed in the wall of the airfoil adjacent to the pressure surface and to the suction surface of the blade resulting in a near wall cooling technique of the turbine airfoil. The matrix can be made to span the longitudinal and chord-wise directions to encompass the entire pressure and suction surfaces or to a lesser portion depending on the heat load of a particular engine application. These cells not only can be arranged in an online array along the airfoil main body, the cells can also be a staggered array along the airfoil main body.

In addition, this invention contemplates the use of means for generating vortices in each of the passages to enhance heat transfer and the conductive characteristics of the cooling system. The multi-vortex cell of this invention serves to generate a high coolant flow turbulence level and, hence, yields a very high internal convection cooling effectiveness in comparison to the single pass construction described in the U.S. Pat. No. 5,720,431, supra.

In accordance with this invention, the designer can design each individual cell based on airfoil gas side pressure distribution in both the chord-wise and radial directions. Additionally each cell can be designed to accommodate the local external heat load on the airfoil so as to achieve a desired local metal temperature.

The discharge angle of the discharge passage of the vortex cooling passage is oriented to provide a film cooling hole where the discharge angle will enhance the film cooling effectiveness of the coolant. As will be appreciated by those familiar with this technology, film cooling on the suction side downstream of the gage point, i.e., the point where the two adjacent blades define the throat of the passage between blades, adversely affects the aerodynamics of film mixing and hence is a deficit in performance. This then becomes a trade-off in design to either obtain the benefits of film cooling in deference to these aerodynamic losses. To avoid the aerodynamic losses in heretofore known cooling schemes, in accordance with this invention cooling the suction side of the blade downstream of the gage point is provided by the airfoil internal multi-pass serpentine passage. This invention has the advantage over these schemes and hence is a significant improvement because the aft portion of the suction side wall of the airfoil can be internally cooled with the multi-vortex cell of this invention before discharging the coolant through the film discharge holes as a film upstream of the gage point in contrast to being discharged downstream of the gage point and thus, avoiding the aerodynamic losses associated with film mixing.

SUMMARY OF THE INVENTION

An object of this invention is to provide for the turbine of a gas turbine engine improved means for cooling the pressure and suction surfaces of the airfoil.

A feature of this invention is to provide for the airfoil, a matrix consisting of a plurality of cells spanning the radial and chord-wise expanse of the airfoil and each cell includes a plurality of cylindrically shaped spaced channels formed in the wall of the turbine airfoil adjacent to the exterior thereof and being discretely interconnected by a coolant through a passage that is disposed tangentially thereto so as to impart a vortex within the channel.

Another feature of this invention is to provide a plurality of channels near the pressure and suction surfaces of a turbine airfoil wherein each of said channels extend radially and are spaced chord-wise and each channel is fluidly connected to the adjacent by a passage which passage for alternate connections is radially spaced therefrom and the coolant is received from a mid-chord passage and discharged from a film cooling slot. The flow from channel to channel may be in the direction of the tip to the root of the blade or vice versa.

Another feature of this invention is to provide a matrix of cells on the suction side of the airfoil such that a plurality of radially extending spaced channels formed in the wall of the turbine downstream of the gage point and where each channel includes vortically flowing coolant and are fluidly connected to each other for cooling the suction side wall and discharging the coolant into a film cooling slot upstream of the gage point.

The foregoing and other features of the present invention will become more apparent from the following description and accompanying drawings.

Figure 1:
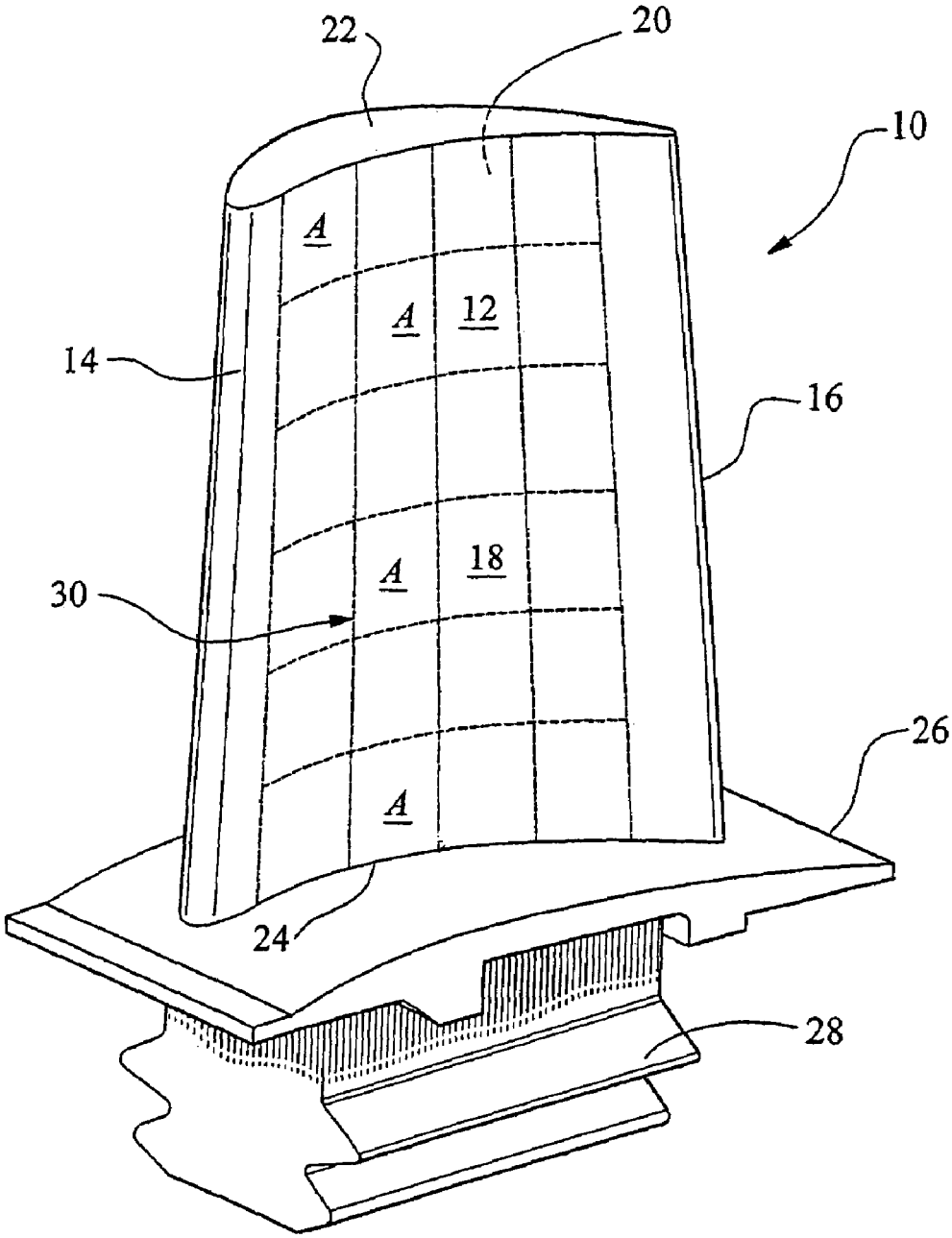
FIG. 1 is a perspective view illustrating a turbine blade for a gas turbine engine having superimposed thereon a matrix designating each of the cells of this invention.
Figure 2:
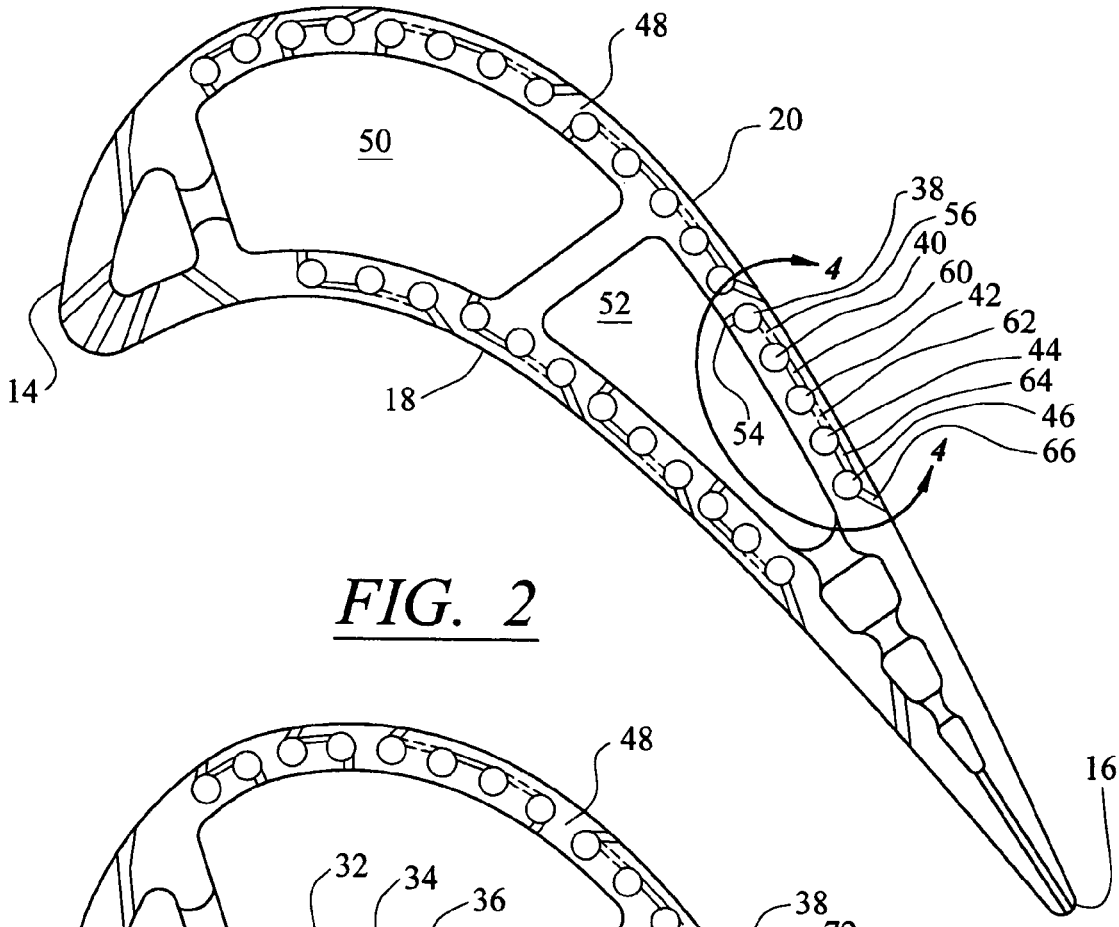
FIG. 2 is a view of a station taken along the chord-wise direction illustrating the details of the cells of this invention.

These figures merely serve to further clarify and illustrate the present invention and are not intended to limit the scope thereof.

DETAILED DESCRIPTION OF THE INVENTION

While this invention is being described showing a particular configured turbine blade as being the preferred embodiment, as one skilled in this art will appreciate, the principals of this invention can be applied to any other turbine blade that requires internal cooling and could be applied to vanes as well. Moreover, the number of cells and their particular shape and location can be varied depending on the particular specification of the turbine operating conditions. The leading edge and trailing edge cooling configuration and technique are not apart of this invention and any well known techniques could also be utilized and as mentioned earlier the technique described in U.S. patent application Ser. No. 10/791,581 could equally be utilized.

A better understanding of this invention can be had by referring to FIGS. 1 through 5 which illustrate a turbine blade generally indicated by reference numeral 10 (FIG. 1) comprising the airfoil 12 having a leading edge 14, a trailing edge 16, a pressure side 18, a suction side 20, a tip 22 and a root 24 and the airfoil 12 extends from the platform 26 and the attachment 28, which in this illustration is a typical fir-tree attachment. The blade 10 is mounted on a turbine disc (not shown) which is attached to the main engine shaft (not shown) for rotary motion. As is typical in gas turbine engines air introduced to the engine through the inlet of the engine is first pressurized by a compressor (a fan may be utilized ahead of the compressor) and the pressurized air is diffused and delivered to a combustor where fuel is added to generate high pressure hot temperature gases which is the engine working medium. The engine working medium is delivered to the turbine section where energy is extracted to power the compressor and the remaining energy is utilized for developing thrust or horsepower, depend on the type of engine.

Figure 3:
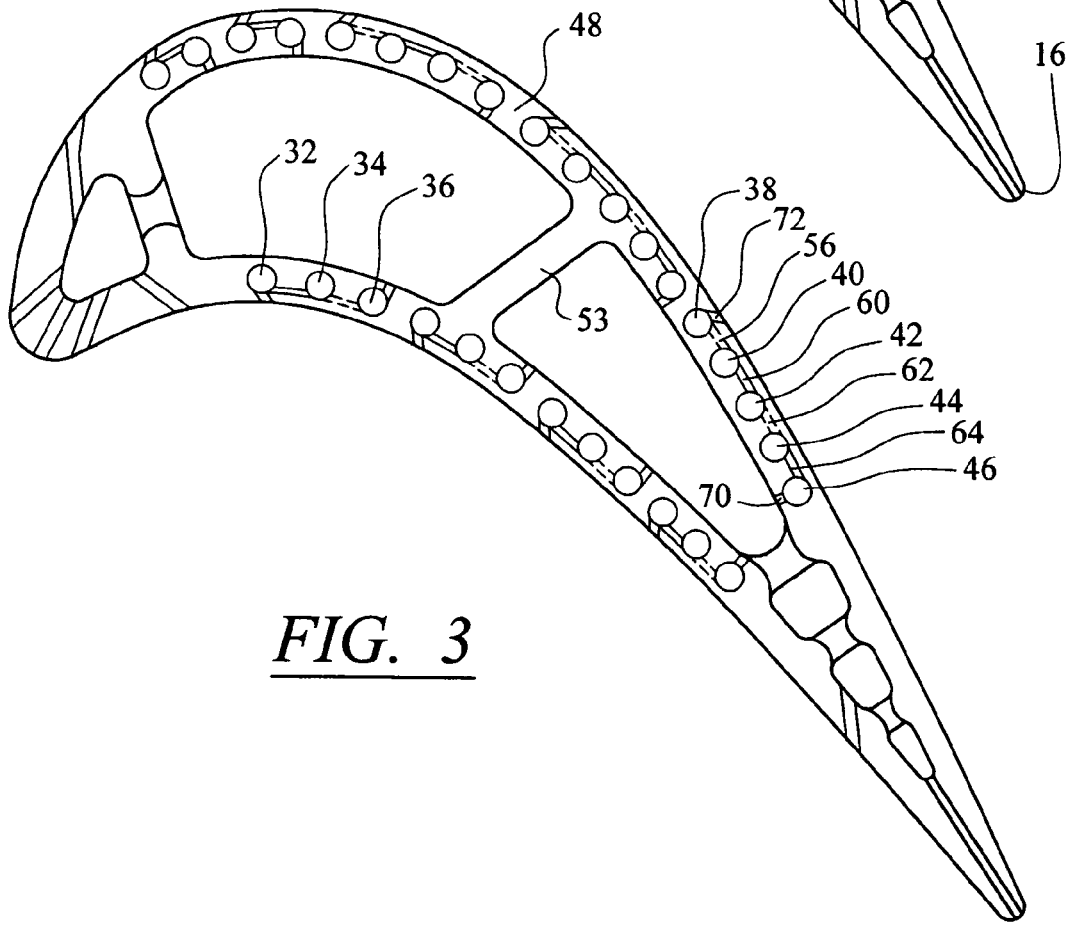
FIG. 3 is a view of the same station of the blade depicted in FIG. 2 where the direction of flow through each cell is reversed.

Since gas turbine engines are well known details thereof are omitted here-from for the sake of convenience and simplicity. However, it is noted that adjacent blades 10 define the space where the engine working medium flows and the dimension of the radial stations of this space varies such that at some station the area is the smallest and defines a throat which is the gage point. Superimposed on the pressure side 18 is a matrix generally indicated by reference numeral 30 is a plurality of rectangularly shaped cells A indicated by the dash lines that span the radial and chord-wise direction of the blade 1O. The size and shape of each cell can vary depending on the particular application and even in this description, it will be noted that the cells on the suction side of the blade are dimensioned differently from the cells on the pressure side of the blades and differ from each other. As will be described in more detail herein below, for example, the cells on the pressure side include three (3) cylindrical chambers 32, 34 and 36 and there are two (2) chambers in some cells on the suction side and five (5) chambers in others. (FIGS. 2 and 3) For the sake of convenience and simplicity a single cell will be described with the understanding that the principal of this invention applies to all of the cells unless indicated otherwise. It should be pointed out here that the only difference between the structure disclosed in FIG. 2 and the structure disclosed in FIG. 3 is the direction of coolant flow in the cells and this will be more fully explained in the paragraphs that follow herein below.

Figure 4A:
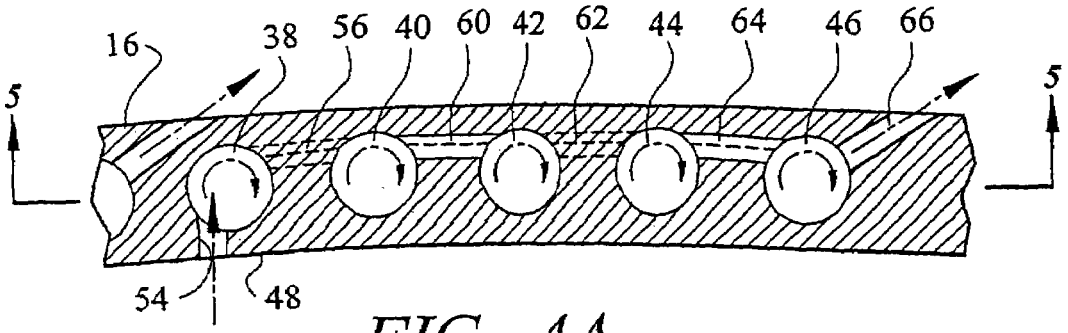
FIG. 4A is a close-up view taken around a cell shown by section 4—4 of FIG. 2.
Figure 5:
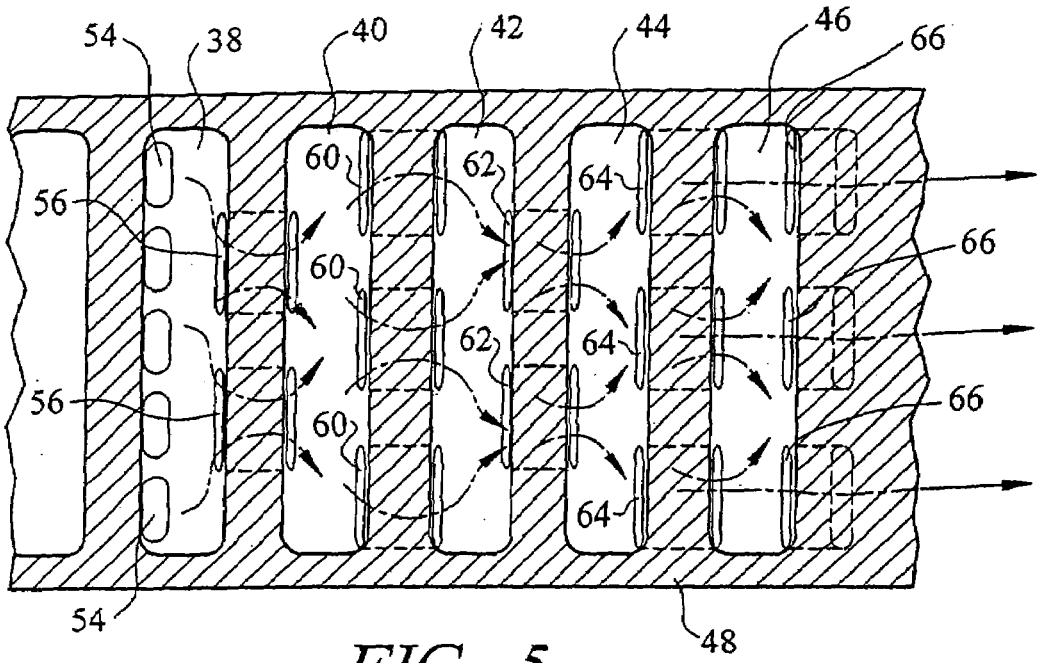
FIG. 5 is a sectional view taken along lines 5—5 of FIG. 4A illustrating the flow pattern within a cell.

Reference will be made to FIGS. 4A and 5 for a detailed description of one of the cells A. As noted cell A includes five (5) cylindrical chambers 38, 40, 42, 44 and 46 formed in the wall 48 and extend in the direction of the leading edge 14 toward the trailing edge 16 and are adjacent to the exterior surface of the suction side. In this embodiment the wall 48 is configured to define the airfoil and is sufficiently thick to accommodate the chambers of each of the cells A and thus allows the location of these chambers to be close to the exterior surface of the airfoil and to the engine working medium so as to achieve near wall cooling. In this blade, the wall 48 defines a pair of mid-span coolant supply passages 50 and 52, separated by the spar 53, extending radially from the root 24 to the tip 22 that receive a coolant in a well known manner from the bottom of the attachment 28. Typically this coolant is air bled from the compressor (not shown). Flow of the coolant from passage 52 flows into the first chamber 38 through the plurality of radially spaced slots 54 formed in wall 48 which slots are oriented tangentially with respect to the cylindrical chamber 38. The purpose of the particular location and orientation of each of the slots 54 is to impart a vortex motion to the flow being introduced into chamber 40, then chamber 42, then chamber 44, then lastly into chamber 46 through the span-wise passages 56, 60, 62 and 64, respectively. The flow from this cell A is then discharged through film cooling slots 66 to form a film of cooling air adjacent the other surface of the wall 48 on the suction side 20 via the film cooling slots 66. As is apparent from this FIG. 4A, each of the passages 56, 60, 62 and 64 are offset from each other in the radial direction and are tangentially disposed relative to the cooperating cylindrical chamber to maximize the creation of the vortex in each of the chamber and hence, maximize the cooling effectiveness of this technique. It will also be noted that the angle of slots 66 with respect to the outer surface of wall 48 is selected to maximize the film cooling effect of the coolant being discharged from the blade 10.

Figure 4B:
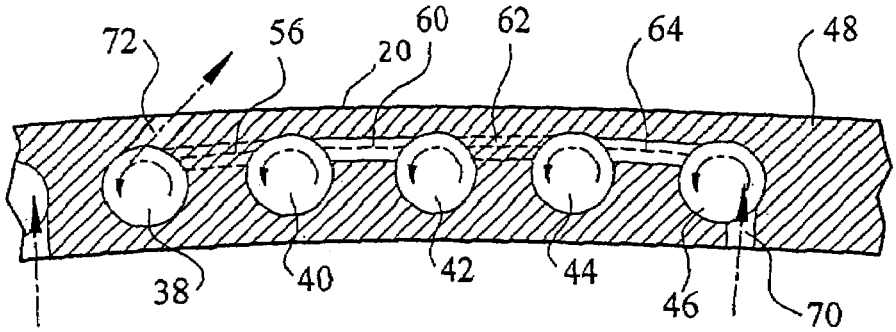
FIG. 4B is a view identical to the view depicted in FIG. 4A modified to illustrate the flow pattern when the flow is reversed with a cell.

FIG. 4B illustrates the flow pattern is reversed from the pattern disclosed in connection with the cell depicted in FIG. 4A where the flow of the coolant in a cell is directed from a direction of the trailing edge toward the leading edge. (Like reference numerals depict like parts in all Figs). As noted in this instance the coolant is admitted into chamber 46 via the slots 70 and ultimately discharge from the blade through film cooling slots 72 and the near wall cooling technique is identical to that described in connection with the configuration depicted in FIG. 4A.

As mentioned in the above paragraphs, in addition to the other mentioned benefits, this invention provides a significant improvement for the airfoil suction side wall cooling because it allows the design to internally cool the aft portion of the suction side wall of the airfoil before dumping the coolant from the blade through the film cooling slots upstream of the gage point. This concept serves to provide effective convective cooling while avoiding aerodynamic losses associated with film mixing at the junction point where the air discharges from the blade and mixes with the engine fluid working medium. This concept affords the designer to utilize the vortex cells in a single, double or multiple series of vortex formation depending on the airfoil heat load and metal temperature requirements. Each cell can be arranged in a staggered or in-line array of cells extending along the main body wall of the blade. With this cooling construction approach, the usage of cooling air is maximized for a given airfoil inlet gas temperature and pressure profile. In addition the vortex chambers in each of the cells generate high coolant flow turbulence levels and yields a very high internal convection cooling effectiveness in comparison to the single pass radial flow channels used for internal turbine blade cooling for hereto known blades. The present invention allows for the cooling to match the varying source pressures form inside the cooling supply cavities in the airfoil (not shown) and the differing sink pressures outside the airfoil on its outer surface.

What has been described by this invention is an efficacious cooling technique that has the characteristics of allowing the turbine blade designer to tailor the multi-vortex cooling of a turbine blade to a particular engine application, by selecting the cell locations and sizes to accommodate the heat loads contemplated by the blade during the engine operating envelope.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. Means for cooling the pressure side of a turbine airfoil, said airfoil having a wall defining the outer surface on said pressure side, a mid-chord passage defined by said wall for receiving coolant, a matrix formed by a plurality of cells extending in the longitudinal direction and the chord-wise direction in said pressure side, each of said cells comprising at least two cylindrical chambers spaced in the chord-wise direction and extending in the longitudinal direction being fluidly connected to said mid-chord passage, a first fluid connection interconnecting said mid-chord passage and one of said at least two cylindrical chambers, said first fluid connection being oriented to flow coolant into said one of said at least two cylindrical chambers at a tangent so as to create a swirling motion of the coolant and a second fluid connection interconnecting said one of said at least two cylindrical chambers and the other of said at least two cylindrical chambers, and said second fluid connection interconnecting said first fluid connection and said second fluid connection being oriented to flow coolant into said other of said at least two cylindrical chambers tangentially to create a swirling motion therein and a third fluid connection discharging coolant from said other of said at least two cylindrical chambers to adjacent said outer surface.

2. Means for cooling the pressure side of a turbine airfoil as claimed in claim 1 wherein said first fluid connection is staggered longitudinally relative to said second fluid connection.

3. Means for cooling the pressure side of a turbine airfoil as chimed in claim 1 including additional cylindrical chambers extending in the chord-wise direction, each having an interconnecting passageway fluidly connecting adjacent cylindrical chambers to each other and said passageway being oriented tangentially relative to each of said adjacent cylindrical chamber to flow coolant therein and imparting thereto a swirling motion.

4. Means for cooling the pressure side of a turbine airfoil as claimed in claim 3 wherein each of said passageways is staggered in the longitudinal direction relative to the passageways in adjacent cylindrical chambers.

5. Means for cooling the suction side of a turbine airfoil, said airfoil having a wall defining the outer surface on said suction side, a mid-chord passage defined by said wall for receiving coolant, a matrix formed by a plurality of cells extending in the longitudinal direction and the chord-wise direction in said suction side, each of said cells comprising at least two cylindrical chambers spaced in the chord-wise direction and extending in the longitudinal direction being fluidly connected to said mid-chord passage, a first fluid connection interconnecting said mid-chord passage and one of said at least two cylindrical chambers, said first fluid connection being oriented to flow coolant into said one of said at least two cylindrical chambers at a tangent so as to create a swirling motion of the coolant and a second fluid connection interconnecting said one of said at least two cylindrical chambers and the other of said at least two cylindrical chambers, and said second fluid connection interconnecting said first fluid connection and said second fluid connection being oriented to flow coolant into said other of said at least two cylindrical chambers tangentially to create a swirling motion therein and a third fluid connection discharging coolant from said other of said at least two cylindrical chambers to adjacent said outer surface.

6. Means for cooling the suction side of a turbine airfoil as claimed in claim 5 wherein said first fluid connection is staggered longitudinally relative to said second fluid connection.

7. Means for cooling the suction side of a turbine airfoil as claimed in claim 5 including additional cylindrical chambers extending in the chord-wise direction, each having an interconnecting passageway fluidly connecting adjacent cylindrical chambers to each other and said passageway being oriented tangentially relative to each of said adjacent cylindrical chamber to flow coolant therein and imparting thereto a swirling motion.

8. Means for cooling the suction side of a turbine airfoil as claimed in claim 7 wherein each of said passageways is staggered in the longitudinal direction relative to passageways in adjacent cylindrical chambers.

9. Means for cooling the suction side of a turbine airfoil as claimed in claim 7 wherein the direction of flow of coolant in said passageways are oriented so that the coolant is discharged as a film of coolant through said third fluid connection upstream of the gage point of said turbine airfoil whereby aerodynamic losses associated with film mixing are substantially eliminated.

10. Vortex cooling means for cooling the pressure side and suction side of a turbine airfoil, said airfoil having a wall defining the outer surface on said pressure side and said suction side, a mid-chord passage defined by said wall for receiving coolant, a matrix formed by a plurality of cells extending in the longitudinal direction and the chord-wise direction in said pressure side and in said suction side, each of said cells comprising at least two cylindrical vortex chambers spaced in the chord-wise direction and extending in the longitudinal direction being fluidly connected to said mid-chord passage, a first fluid connection interconnecting said mid-chord passage and one of said at least two cylindrical vortex chambers, said first fluid connection being oriented to flow coolant into said one of said at least two cylindrical chambers at a tangent so as to create a vortex of the coolant therein and a second fluid connection interconnecting said one of said at least two cylindrical vortex chambers and the other of said at least two cylindrical vortex chambers, and said second fluid connection interconnecting said first fluid connection and said second fluid connection being oriented to flow coolant into said other of said at least two cylindrical chambers tangentially to create a vortex therein and a third fluid film connection discharging coolant from said other of said at least two cylindrical chambers to adjacent said outer surface to form a film of coolant there over.

11. Vortex cooling means for cooling the pressure side and suction side of a turbine airfoil as claimed in claim 10 wherein said first fluid connection is staggered longitudinally relative to said second fluid connection.

12. Vortex cooling means for cooling the pressure side and suction side of a turbine airfoil as claimed in claim 10 including additional cylindrical vortex chambers extending in the chord-wise direction, each having an interconnecting passageway fluidly connecting adjacent cylindrical vortex chambers to each other and said passageway being oriented tangentially relative to each of said adjacent cylindrical chamber to flow coolant therein and imparting thereto a vortex motion.

13. Vortex cooling means for cooling the pressure side and suction side of a turbine airfoil as claimed in claim 12 wherein each of said passageways is staggered in the longitudinal direction relative to the passageways interconnecting adjacent vortex chambers.

14. A turbine blade having an attachment portion and an airfoil, said airfoil having a leading edge, a trailing edge, a tip, a root, a pressure side and a suction side, vortex cooling means for cooling the pressure side and suction side of a turbine airfoil, said airfoil having a wall defining the outer surface on said pressure side and said suction side, a mid-chord passage defined by said wall receiving coolant from an opening in said attachment portion, a matrix formed by a plurality of cells extending in the longitudinal direction from said root toward said tip and the chord-wise direction from said leading edge toward said trailing edge in said pressure side and in said suction side, each of said cells comprising at least two cylindrical vortex chambers spaced in the chord-wise direction and extending in the longitudinal direction being fluidly connected to said mid-chord passage, a first fluid connection interconnecting said mid-chord passage and one of said at least two cylindrical vortex chambers, said first fluid connection being oriented to flow coolant into said one of said at least two cylindrical chambers at a tangent so as to create a vortex of the coolant therein and a second fluid connection interconnecting said one of said at least two cylindrical vortex chambers and the other of said at least two cylindrical vortex chambers, and said second fluid connection interconnecting said first fluid connection and said second fluid connection being oriented to flow coolant into said other of said at least two cylindrical chambers tangentially to create a vortex therein and a third fluid film connection discharging coolant from said other of said at least two cylindrical chambers to adjacent said outer surface to form a film of coolant there over.

15. A turbine blade having an attachment portion and an airfoil, said airfoil having a leading edge, a trailing edge, a tip, a root, a pressure side and a suction side as claimed in claim 14 wherein said first fluid connection is staggered longitudinally relative to said second fluid connection.

16. A turbine blade having an attachment portion and an airfoil, said airfoil having a leading edge, a trailing edge, a tip, a root, a pressure side and a suction side as claimed in claim 14 including additional cylindrical vortex chambers extending in the chord-wise direction, each having an interconnecting passageway fluidly connecting adjacent cylindrical vortex chambers to each other and said passageway being oriented tangentially relative to each of said adjacent cylindrical chamber to flow coolant therein and imparting thereto a vortex motion.

17. A turbine blade having an attachment portion and an airfoil, said airfoil having a leading edge, a trailing edge, a tip, a root, a pressure side and a suction side as claimed in claim 16 wherein each of said passageways is staggered in the longitudinal direction relative to the passageways interconnecting adjacent vortex chambers.

18. A turbine blade having an attachment portion and an airfoil, said airfoil having a leading edge, a trailing edge, a tip, a root, a pressure side and a suction side as claimed in claim 17 wherein the direction of flow of coolant in said passageways is from the trailing edge toward said leading edge.

19. A turbine blade having an attachment portion and an airfoil, said airfoil having a leading edge, a trailing edge, a tip, a root, a pressure side and a suction side as claimed in claim 17 wherein the direction of flow of coolant in said passageways is from the leading edge toward said trailing edge.

* * * * *